United States Patent [19]

Hannah

[11] Patent Number: 4,617,746

[45] Date of Patent: Oct. 21, 1986

[54] KICKING SHOE

[76] Inventor: Mark Hannah, 206 Cedar Ave., Hinton, W. Va. 25951

[21] Appl. No.: 764,402

[22] Filed: Aug. 12, 1985

[51] Int. Cl.[4] ..... A43B 5/00; A43B 5/02

[52] U.S. Cl. ..... 36/133; 36/128

[58] Field of Search ..... 36/133, 128, 114; 273/55 B

[56] References Cited

U.S. PATENT DOCUMENTS 4,422,249 12/1983 Hannah ..... 36/133

FOREIGN PATENT DOCUMENTS 910395 7/1953 Fed. Rep. of Germany ..... 36/128
176180 3/1922 United Kingdom ..... 36/128
367516 2/1932 United Kingdom ..... 36/114
1293925 10/1972 United Kingdom ..... 36/128

*Primary Examiner*—James Kee Chi
*Attorney, Agent, or Firm*—Harry M. Weiss & Associates

[57] ABSTRACT

An improved kicking shoe having a generally durable sheath housing and a pad upwardly protruding from the front portion of the shoe is disclosed. The pad has an inclined precipice at a first end portion having an apex located at a substantially central portion of the shoe. The second end portion of the pad being directly opposed to the first end substantially wraps around a side portion at a downwardly sloping incline extending substantially from said central portion to the bottom portion of the shoe. By providing a protruding pad originating substantially from said central portion to the bottom portion of the shoe, this substantially improves the range or accuracy of the trajectory of the ball upon impact with kicking portion of the pad of the kicking shoe. The protruding pad may in general be in the form of a golf club iron for allowing greater distance and control of the trajectory of a kicked ball to specifically minimize a hook, slice or shank to occur in the trajectory and to provide therefrom a characteristic of a quick rise on the football immediately after impact on the improved kicking pad.

22 Claims, 5 Drawing Figures

KICKING SHOE

BACKGROUND OF THE INVENTION

This invention generally relates to an improvement in a sports equipment, specifically, an improved kicking shoe, in games which permits or, in many instances, requires a game player to kick a ball. Such games where the instant invention of an improved kicking shoe is extremely useful is in the traditionally played American game of football. The instant invention is an improvement in both the distance and accuracy gained by a game kicker when using the instant improved kicking shoe.

In the traditionally played American game of football, plays that are executed several times during a game require the kicking of a ball. Generally, a place kick, wherein a stationary football is kicked either from a tee, or from a held position, is normally performed each game. The ability of a player to accurately kick the stationary football for a substantial distance is essential in order to establish the furthest range in which an opposing team must traverse to score a goal; i.e., the points essential to winning a game. Thus, the ability of a player to accurately kick the stationary football for a substantial distance is a skill highly valued at both amateur and professional levels of the sport.

Moreover, a place kick is typically executed each game in order to score points by kicking the football between the "uprights" located at an end zone of the football field.

Various attempts have been made to improve the range and accuracy of a stationary football kicked from a tee or from a held position. The traditional kicking technique involves a direct approach by the kicker toward the ball, with the kicking foot being swung in a common plane with the intended trajectory. To improve the range of such a "head-on" kicking technique, hard-faced kicking shoes were introduced, with a block mounted in the toe region which contacts the football. The block in the toe is substantially rigid, and produces a sharper impact upon the football than would an ordinary athletic shoe. Moreover, the tee block is relatively flat thereby providing more kicking surface area which creates a more accurate impact. Also, a kicker often produces a similar effect by upwardly bending the front portion of his shoe and by tying his shoe laces around his ankle to secure the upwardly bent position to provide a simulation of a flat kicking surface, as is the toe block, and as well as a relatively angled impact for creating a more desired trejectory.

In all the above-mentioned techniques, attempts were made to provide a sharper impact on the football which in turn increases the range by which the kicker can kick the football.

Subsequently, a technique of "soccer-style" kicking was introduced, wherein the kicker approaches a teed-up or held football from a path diagonal to the intended path of travel of the ball. Soccer-style kicking gave the kicker the ability to increase the available momentum by lengthening both the radius and the length of the arc through which the kicking foot was swung, and also permitted the kicker to utilize a larger proportion of the body muscle structure to propel the kicking foot. The actual contact with the ball occurred on the instep of the kicking foot. The resulting notable increase in range produced a general adaptation of the soccer-style kicking technique.

Notwithstanding the developments of the past, football games continued to be won and lost according to the particular range and accuracy based on the abilities of individual kickers, and a need continued to exist for a method or apparatus to improve upon these parameters.

In order to provide the means in which both a particular range and accuracy may be consistently achieved, it is known in the related art, as disclosed in Applicant's U.S. Pat. No. 4,422,249, filed on Mar. 16, 1981 and issued on Dec. 27, 1983, that an angularly protruding pad may be attached on the surface of a kicking shoe overlying the inside instep portion for providing a striking surface. However, the striking surface of the shoe being located approximately near the side falls short in providing the maximum initial trajectory upon impact of a ball on a desired striking shoe surface essential to achieving long range and desired accuracy.

A need was therefore felt to assist a football kicker by providing a kicking shoe having a pad centrally attached thereto on the upper portion of the shoe with an increased pad surface to permit a kicker to achieve significant improvement in both the range and accuracy during his kicking duties in a football game.

It is therefore an object of the present invention to provide an improved kicking shoe in a game, such as football, to attain long range and desired accuracy in the kicked ball.

It is another object of the present invention to provide an improved kicking apparatus having an improved pad directly centered on the surface of the shoe for providing an increased kicking surface area.

It is still another object of the present invention to provide an improved kicking shoe having an inclined precipice in one end of the pad opposite a kicking surface having at least one sloping decline for providing the needed trajectory to achieve a much improved range and accuracy in the flight of a ball after impact with the shoe.

It is further object of the present invention to provide an improved kicking pad which can be easily produced, yet sturdy in construction and highly efficient in operation.

It is a further object of the present invention to provide an improved kicking shoe having an improved kicking pad which is constructed with extreme simplicity, embodying simple parts, and therefore capable of being retailed for a low price, long-lasting in use, and convenient to handle.

It is a more particular object of the present invention to provide an improved kicking shoe having an improved kicking pad substantially protruding at an apex above the central portion of the shoe and having the opposing edge of the pad broadly and substantially proximate to the bottom portion of the shoe.

It is alternatively a more particular object of the present invention to provide an improved kicking shoe having an improved kicking pad in the shape of a golf club iron for allowing greater control of the trajectory of the kicked ball to specifically minimize a hook, slice or shank to occur in the trajectory and to further provide therefrom a characteristic of a quick rise on the football immediately after impact with the improved kicking pad.

SUMMARY OF THE INVENTION

The aforementioned and other objects of the present invention are accomplished by providing an improved kicking shoe having a generally durable sheath housing a pad upwardly protruding from the front portion of the shoe. The pad has an inclined precipice at a first end portion having an apex located at a substantially central portion of the shoe. The second end portion of the pad being directly opposed to the first end substantially wraps around a side portion at a downwardly sloping incline extending substantially from said central portion to the bottom portion of the shoe. By providing a protruding pad originating substantially from said central portion to the bottom portion of the shoe, this substantially improves the range or accuracy of the trajectory of the ball upon impact with a kicking portion of the pad of the kicking shoe. The protruding pad may in general be in the form of a golf club iron for allowing greater distance and control of the trajectory of a kicked ball to specifically minimize a hook, slice or shank to occur in the trajectory and to provide therefrom a characteristic of a quick rise on the football immediately after impact on the improved kicking pad.

These and other features of the invention will be understood upon reading of the following description along with the drawings.

DESCRIPTION OF THE PREFERRED EMBODIMENTS

Figure 1:
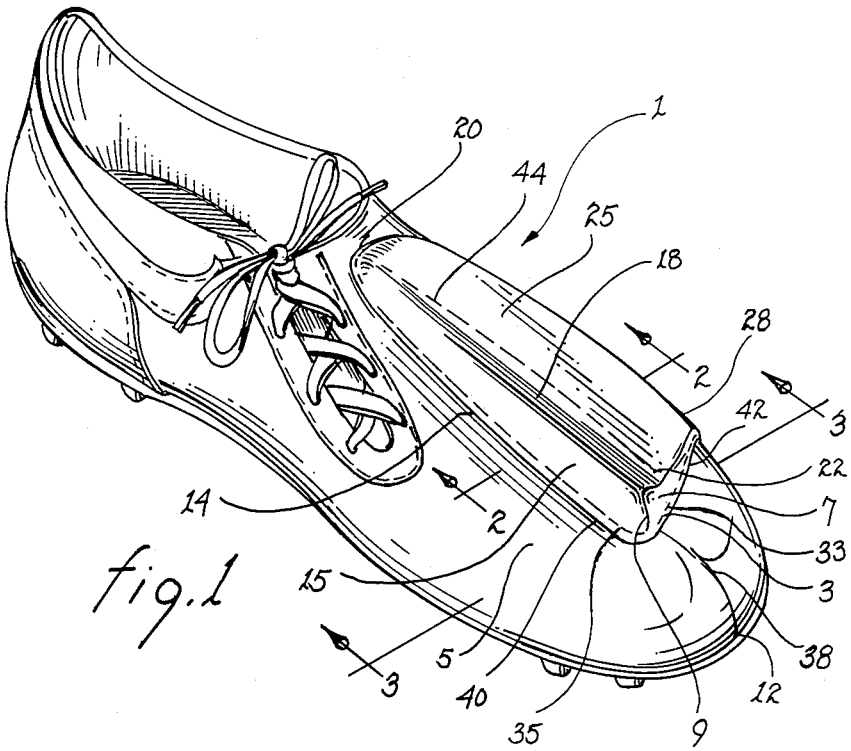
FIG. 1 is a perspective view of the preferred embodiment of an improved kicking shoe in accordance with the present invention showing the kicking shoe having on the front portion an integral protruding pad originating from a substantially central portion and extending towards the bottom portion of the shoe.

FIG. 1 is a perspective view of an improved kicking shoe, generally designated by reference number 1. The kicking shoe 1 has a pad 3 integrally coupled to the front portion 5 of the shoe 1. The pad upwardly protrudes to an apex 7 above the front edge 9 substantially in line with a center-line 12 longitudinally extending along the length of the shoe 1. The pad 3 has an inclined precipice 14 at a first end portion 15 having an upper edge 18 backwardly and downwardly sloping from the apex 7 to the middle portion 20 of the shoe 1. The inclined precipice 14 has a maximum height at the apex 7 gradually descreasing when extending longitudinally towards the middle portion 20.

A side planar portion 22 angularly opposed to the first end portion 15 slopingly extends downwards towards a side surface 25 which initially has a lesser downward slope than the planar portion 22. The side surface 25 extends downward and curving to substantially wrap around a preferable kicking side 28. A front planar portion 33 similarly has a maximum height at the apex 7 gradually decreasing when extending downwardly towards the bottom portion of the shoe, as will later be discussed.

The pad 3 is preferably joined to the front portion 5 of the shoe 1 by thread means 35, 38 at the bottom ends 40, 42 of the inclined precipice 14 and the front planar portion 33, respectively. Moreover, the side planar portion 22 is operably distinguished from the side surface 25 by a threaded means 44 extending longitudinally from the front planar portion 33 towards the middle portion 20.

Figure 2:
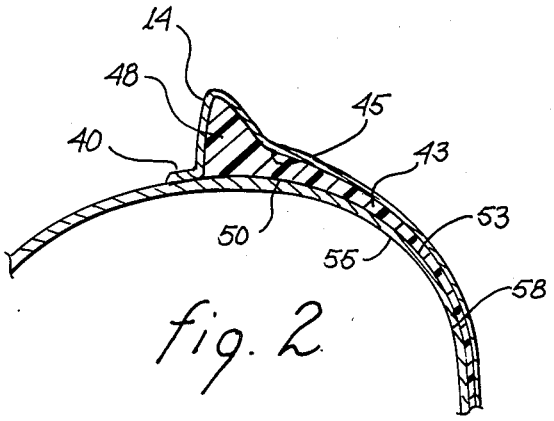
FIG. 2 is a cross-sectional view of the improved kicking shoe taken in the direction of arrows 2—2 shown in FIG. 1 illustrating a sheath of the front portion of the shoe having thereon the integral protruding pad with an associated durable sheath housing.

As shown in the cross-sectional view of the pad 3 with the associated front portion 5 of the shoe 1, a sheath housing 43 wholly overlaps the top portion 45 of a block member 48. The bottom portion 50 of the block member 48 abuts the external portion 53 of a shoe covering member 55 at locations previously discussed and as further shown in FIG. 2. Here, the bottom end 40 of the inclined precipice 14 is shown extending substantially parallel to the abutting shoe covering member 55. The sheath housing 43 is preferably made out of a durable and long-lasting material; such as, leather, soft plastic or any other material similary to that used for the shoe covering member 55.

Figure 4:
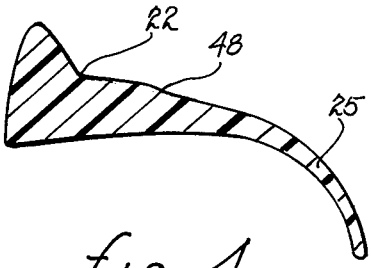
FIG. 4 is a cross-sectional section of the pad showing the top portion with a first end portion having an inclined precipice upwardly protruding to an apex and thereafter downwardly sloping in a curving direction.
Figure 3:
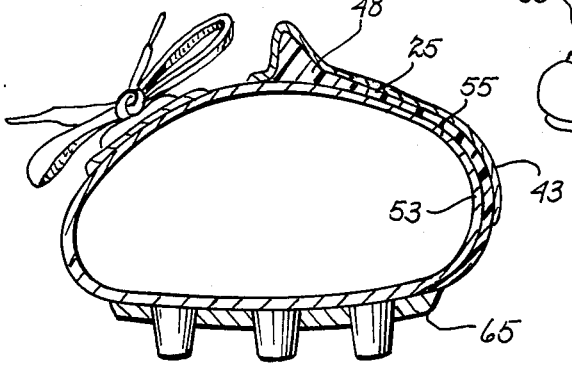
FIG. 3 is a cross-sectional view of the improved kicking shoe taken in the direction of arrows 3—3 shown in FIG. 1 illustrating the kicking shoe sheath having integrally mounted thereon the protruding pad with the associated durable sheath housing.

As illustrated in FIG. 3, the block member 48 (as more specifically shown in FIG. 4) extends downwards and curving to substantially wrap around a side 53 of the shoe, to permit the associated sheath housing 43 abutting thereon to establish a broad and expanded side surface 25 for improved contact surface during the shoe impact on a ball. The end portion 60 of the side surface 25 of the sheath housing 43 is preferably permanently attached to the bottom portion 63 of the shoe covering member 55 on the sole member 65. The block member 48 in the above-mentioned embodiments is preferably made of hard rubber sponge, hard plastic or any other durable material. The block member 48 inherently provides the top surface football contact portion or shape of the pad 3, in general, to be in the form of a golf club iron which integrally encompasses therein the side planar portion 22 and the upper portion of the side surface 25.

Figure 5:
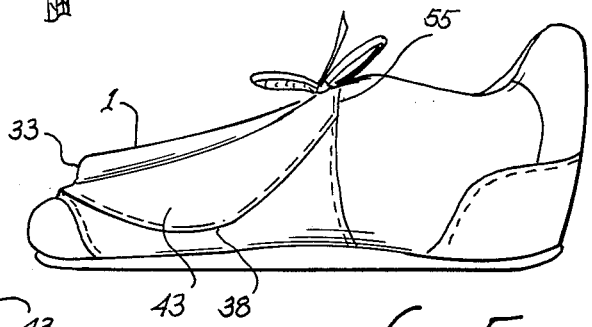
FIG. 5 is a side elevational view of the improved kicking shoe in accordance with the present invention showing how a second end portion of the pad with the associated sheath housing extending downwardly to the bottom portion of the shoe in order to provide a sufficient kicking surface.

As shown in FIG. 5, the downwardly extending block member 48 is preferably fastened to the abutting sheath housing 43 and covering member 55 by the thread means 38 originating from the front planar portion 33, as previously described.

While the invention has been particularly shown and described in reference to preferred embodiments thereof, it will be understood by those skilled in the art that changes in form and details may be made without departing from the spirit and scope of the invention.

I claim:

1. An improved kicking shoe for use in a game which permits a game player to kick a ball, comprising:

a pad means which is positioned on the front portion of said shoe for integrally coupling thereabove, said pad means upwardly protrudes to an integral apex substantially in line with a center-line longitudinally extending along said shoe, said pad means integrally having: (a) an inclined precipice at a first end portion having an upper edge downwardly sloping from said integral apex to the middle portion of said shoe, (b) a side planar portion angularly opposed to said first end portion, (c) a side surface extending downward to wrap around a kicking side of said shoe, said side surface has a lesser downward slope than said planar portion slope, and (d) a front planar portion having a maximum protruding height at said integral apex and gradually decreasing therefrom when extending downwardly towards the bottom of said shoe; and a sheath housing means integrally joined on said front portion of said shoe for overlapping the top portion of said pad means.

2. The improved kicking shoe as in claim 1 wherein said pad means, further comprising:

a first bottom end means integrally joined to said inclined precipice for anchoring said inclined precipice to said shoe; and a second bottom end means integrally joined to said front planar portion for anchoring said front planar portion to said shoe.

3. The improved kicking shoe as in claim 2 wherein said pad means, further comprising:

a first thread means for integrally connecting said first bottom end means to said shoe; and a second thread means for integrally connecting said second bottom end means to said shoe.

4. The improved kicking shoe as in claim 3 wherein said pad means, further comprising:

a third thread means for operably distinguishing said side planar portion from said side surface, said third thread means extending longitudinally from said front planar portion towards the middle portion of said shoe.

5. The improved kicking shoe as in claim 4 wherein said sheath housing means wholly overlaps the top portion of said pad means.

6. The improved kicking shoe as in claim 5 wherein the bottom portion of said pad means directly abuts the external surface of a covering member in said front portion of said shoe.

7. The improved kicking shoe as in claim 6 wherein said first bottom end means of said inclined precipice extends substantially parallel to said abutting external surface of said covering member in said front portion of said shoe.

8. The improved kicking shoe as in claim 7 wherein said pad means is made from a material selected from the group consisting of hard rubber sponge and hard plastic.

9. The improved kicking shoe as in claim 8 wherein said pad means downwardly extends to wrap around said kicking side of said shoe to form said side surface in order to establish a broad and expanded side surface for improved contact during the shoe impact on said ball.

10. The improved kicking shoe as in claim 9 wherein the bottom end portion of said sheath housing means abutting said side surface of said pad means is permanently attached to the bottom end portion of said covering member proximate a sole member of said shoe.

11. The improved kicking shoe as in claim 10 wherein said downwardly extending pad means is integrally fastened to said abutting sheath housing means and said covering member by said second thread means which originates from said front planar portion.

12. An improved kicking shoe for use in a game which permits a game player to kick a ball, comprising:

a block member which is positioned on the front portion of said shoe for integrally coupling thereabove, said block member upwardly protrudes to an integral apex substantially in line with a certain-line longitudinally extending along said shoe, said block member integrally having: (a) an inclined precipice at a first end portion having an upper edge downwardly sloping from said integral apex to the middle portion of said shoe, (b) a side planar portion angularly opposed to said first end portion, (c) a side surface extending downward to wrap around a kicking side of said shoe, said side surface has a lesser downward slop than side planar portion slope, and (d) a front planar portion having a maximum protruding height at said integral apex and gradually decreasing therefrom when extending downwardly towards the bottom of said shoe;

a sheath housing integrally joined on said front portion of said shoe for overlapping the top portion of said block member;

a first bottom end integrally joined to said inclined precipice for anchoring said inclined precipice to said shoe;

a second bottom end integrally joined to said front planar portion for anchoring said front planar to said shoe;

a first thread means for integrally connecting said first bottom end means to said shoe; and a second thread means for integrally connecting said second bottom end means to said shoe.

13. The improved kicking shoe as in claim 12 wherein said sheath housing wholly overlaps the top portion of said block member.

14. The improved kicking shoe as in claim 13 wherein the bottom portion of said block member directly abuts the external surface of a covering member in said front portion of said shoe.

15. The improved kicking shoe as in claim 14 wherein said first bottom end of said inclined precipice extends substantially parallel to said abutting external surface of said covering member in said front portion of said shoe.

16. The improved kicking shoe as in claim 15 wherein said block member is made from a material selected from the group consisting of hard rubber sponge and hard plastic.

17. The improved kicking shoe as in claim 16 wherein said block member downwardly extends to wrap around said kicking side of said shoe to form said side surface in order to establish a broad and expanded side surface for improved contact during the shoe impact on said ball.

18. The improved kicking shoe as in claim 17 wherein the bottom end portion of said sheath housing abutting said side surface of said block means is permanently attached to the bottom end portion of said covering member proximate a sole member of said shoe.

19. The improved kicking shoe as in claim 18 wherein said downwardly extending block member is integrally fastened to said abutting sheath housing and said covering member by said second thread means which originates from said front planar portion.

20. The improved kicking shoe as in claim 19 wherein the material of said sheath housing is made from a material selected from the group consisting of a material embodied in said covering member, leather and soft plastic.

21. A soccer-style place kick type of a football kicking apparatus, comprising, in combination:

football striking means located on an instep portion of a foot of a kicker; and golf iron club-shaped means located on the upper portion of said football striking means for providing both an increased football striking surface for maximum and controlled impact and for elevating the height of the football struck by said apparatus, said golf iron club-means has at least one edge substantially located longitudinally along the centerline of said apparatus.

22. A method for providing a soccer-style place-kick type of a football kicking apparatus, comprising the steps of:

providing football striking means located on an instep portion of a foot of a kicker; and providing a golf iron club-shaped means located on the upper portion of said football striking means for providing both an increased football striking surface for maximum and controlled impact and for elevating the height of the football struck by said apparatus, said golf iron club-means has at least one edge substantially located longitudinally along the centerline of said apparatus.

* * * * *